US010125971B2

(12) United States Patent
Graziano et al.

(10) Patent No.: US 10,125,971 B2
(45) Date of Patent: Nov. 13, 2018

(54) LED LAMP INTEGRATED TO ELECTRIC FAN

(71) Applicant: Michael Graziano, Austin, TX (US)

(72) Inventors: Yesheswini Graziano, Austin, TX (US); Michael Graziano, Austin, TX (US)

(73) Assignee: Michael Graziano, Austin, TX (US)

( * ) Notice: Subject to any disclaimer, the term of this patent is extended or adjusted under 35 U.S.C. 154(b) by 608 days.

(21) Appl. No.: 13/999,468

(22) Filed: Mar. 3, 2014

(65) Prior Publication Data

US 2015/0086363 A1 Mar. 26, 2015

Related U.S. Application Data

(60) Provisional application No. 61/850,642, filed on Feb. 19, 2013.

(51) Int. Cl.

| | |
|---|---|
| ***F21V 33/00*** | (2006.01) |
| ***F21V 23/00*** | (2015.01) |
| ***F04D 25/08*** | (2006.01) |
| ***F04D 29/00*** | (2006.01) |
| ***F21V 29/83*** | (2015.01) |
| *F21Y 115/10* | (2016.01) |
| *F21Y 113/17* | (2016.01) |

(52) U.S. Cl.

CPC ..... *F21V 33/0096* (2013.01); *F04D 25/088* (2013.01); *F04D 29/005* (2013.01); *F21V 23/003* (2013.01); *F21V 29/83* (2015.01); *F21Y 2113/17* (2016.08); *F21Y 2115/10* (2016.08)

(58) Field of Classification Search

CPC ..... F04D 35/088; F04D 29/005; F21V 29/67; F21V 33/0096; F21V 29/83; F21V 23/003; F21Y 2113/17; F21Y 2115/10

USPC ..... 416/5

See application file for complete search history.

(56) References Cited

U.S. PATENT DOCUMENTS

| | | | | |
|---|---|---|---|---|
| 6,322,232 | B1 | 11/2001 | Oliver | |
| 6,461,032 | B2 * | 10/2002 | McKinley | F04D 25/088 362/148 |
| 8,517,553 | B2 | 8/2013 | Lan et al. | |
| 8,773,949 | B2 * | 7/2014 | Martin | G01V 1/364 367/38 |

(Continued)

OTHER PUBLICATIONS

OSRAM, "Color Stabilization of RGB LEDs in an LLED Backlighting Example", Jan. 2014.*

*Primary Examiner* — William V Gilbert

(57) ABSTRACT

An LED lamp, integrated to electric fan, comprising at least one flat LED lamp that comprises a light box containing, light diffuser, light reflector, multiplicity of packaged LEDs, heat sink, vent holes and printed circuit board, is powered by a programmable LED driver unit. The lamp employs multiplicity of packaged LEDs as a source for generating visible light for illumination. The LED lamp can be made in any shape and size and can be integrated to the electric fan at the front side or back side of the fan. The programmable driver unit can be programmed to apply desired ratio of power to RGB LEDs to generate various colors of light and hues of colors of light from the LED lamp containing multiplicity of packaged RGB LEDs. The program can be adjusted to generate various colors of light and hues of colors of light from the LED lamp depending on the time of the day or night.

5 Claims, 19 Drawing Sheets

(56) References Cited

U.S. PATENT DOCUMENTS

| | | | | |
|---|---|---|---|---|
| 2002/0192077 | A1* | 12/2002 | Tsuji | F21V 33/0088 416/5 |
| 2005/0046334 | A1* | 3/2005 | Fujiwara | C09K 11/883 313/498 |
| 2006/0065957 | A1* | 3/2006 | Hanya | H01L 25/0753 257/676 |
| 2007/0120463 | A1* | 5/2007 | Hayashi | H01L 33/501 313/501 |
| 2008/0128730 | A1* | 6/2008 | Fellows | H01L 33/22 257/98 |
| 2008/0213094 | A1* | 9/2008 | Okimura | F04D 29/005 416/5 |
| 2010/0201611 | A1* | 8/2010 | Duong | H05B 33/086 345/83 |
| 2013/0051067 | A1* | 2/2013 | Chen | G02B 6/0065 362/607 |
| 2013/0343052 | A1 | 12/2013 | Yen | |

* cited by examiner

LED LAMP INTEGRATED TO ELECTRIC FAN

BENEFIT OF PRIOR APPLICATION

Provisional Application No. 61/850,642, Filing date: Feb. 19, 2013

CROSS REFERENCE TO RELATED APPLICATION

U.S. Pat. No. 8,517,553—Lan et. al, Aug. 27, 2013
U.S. Pat. No. 6,322,232—Oliver, Nov. 27, 2001
US Patent Application No. 20130343052—Yen, Dec. 26, 2013

OTHER PUBLICATIONS

1. Osram Optosemiconuctor specification for 'Multiled'. http://catalog.osram-os.com/catalogue/catalogue.do;jsessionid=5070BA8CC05B090A5AF46B3F110AC5E9?favOid=0000000000031bac00060023&act=showBookmark

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

Field of Invention

This invention belongs to the area of LED illumination employed in lighting fixtures and more specifically to the LED lamp integrated to electric fan. This invention claims the priority date of Feb. 19, 2013 of previously filed provisional application No. 61/850,642 by the inventor Yesheswini Graziano.

Recently Light Emitting Diodes (LEDs) have been employed as light sources for various applications, such as home lighting, street lighting, highway lighting, tunnel lighting, architectural lighting, landscape lighting, auto lighting and backlighting for Liquid Crystal Displays (LCDs) in Television. Under the category of home lighting there is a trend of LED light being employed in combination with electric fan in general and ceiling fan in particular. LED lights are normally suspended in the ceiling fan. The lights can also be provided at the back side of the ceiling fan.

Description of Prior Art

In the prior art, the lamps employed with ceiling fan are either traditional incandescent lamp or traditional fluorescent lamps. For example, in one prior art (U.S. Pat. No. 6,322,232) Oliver describes a novel fixture for a ceiling fan with lighting globe that uses a conventional incandescent lamp. The description is extensively on the fixtures for the fan and very little on the light source that functions as 'down-light' with individual lighting globe. In another prior art (U.S. Pat. No. 8,517,553) Lan et. al describes several discrete fluorescent lamps with individual lamp housing suspended from a ceiling fan. In yet another prior art (US Patent Application #20130343052, Yen describes an LED light box containing four rows of LEDs assembled at the center and four strips of LEDs assembled at the four sides of the light box. The box is fixed to the central portion of a ceiling fan as a square or rectangular light box. There is no description of the LEDs employed, specifically on the color changing capability of the LED lamp. Further there is no description about the various orientations and geometries of the LED lamp that is integrated to the ceiling fan.

In all the foregoing inventions, it is clear that a planar LED lamp was not employed around the ceiling fan and the color changing nature of the planar LED lamp, on demand, was absent. Further, no LED lamp above the blades of the fan was employed. Various geometrical shapes and sizes of the LED lamp and different orientations were absent.

BRIEF SUMMARY OF THE INVENTION

According to the present invention, the LED lamp integrated to an electric fan, particularly ceiling fan, comprises plastic light box, reflector, diffuser and multiplicity of LEDs. The plastic light box has different geometrical shapes and sizes. The LEDs are both white light emitting LEDs as well as Red, Blue and Green color light emitting LEDs (RGB LEDs). The RGB LEDs can be programmed through a driver module that connects the lamp for changing the color and hues of colors of light, on demand, and also adjust the color of the light emitted from the lamp depending on the time of the day or night. The RGB LEDs are in a specific discrete package and are assembled inside the plastic light box. Vent holes for cooling the LEDs are provided in the plastic light box in addition to the heat sinking elements.

It is an object of this invention to provide a novel LED lamp integrated to any fan, particularly ceiling fan.

A further object of this invention is to provide a novel LED lamp integrated to a fan and the lamp contains multiplicity of white light emitting LEDs.

Yet another object of this invention is to provide a novel LED lamp integrated to a fan and the lamp contains multiplicity of RGB LEDs.

Yet another object of this invention is to provide a novel LED lamp integrated to a fan and the lamp is provided with a driver that changes the color of light emitted from the lamp, on demand.

Yet another object of this invention is to provide a novel LED lamp integrated to a fan and the lamp is provided with a driver that is programmed to change the color of light from the lamp depending on the time of the day or night.

Yet another object of the invention is to provide a novel LED lamp integrated to a fan and the lamp having different geometrical shapes and sizes.

Yet another object of this invention is to provide a novel LED lamp integrated to a fan and the lamp is oriented at the back of a fan or at the front of a fan or center of a fan depending on the design.

DETAILED DESCRIPTION OF DRAWINGS

Figure 1:
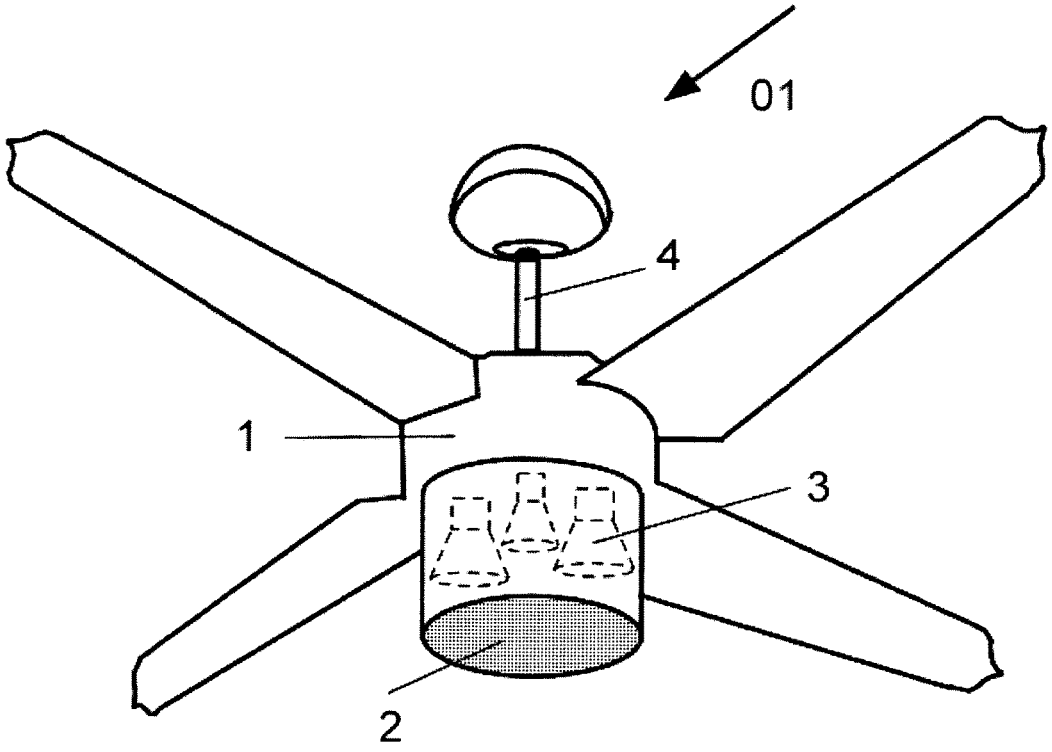
Fig. 1 (Prior Art)
FIG. 1 is an isometric view of traditional incandescent lamp integrated to a ceiling fan according to one prior art.

FIG. 1 is an isometric view of a lamp, according to one prior art. The ceiling fan 01 that has the main body 1 of the fan integrated to an incandescent lamp 2 that contains individual traditional incandescent bulbs 3. The means for connecting power to the fan and the bulbs come through the main tubular supporting rod 4. It can be seen that the main lamp is bulky and not flat, further the color of light depends on the color emitted by the individual bulbs. One cannot change the color of emitted light on demand at specific time of the day.

Figure 2:
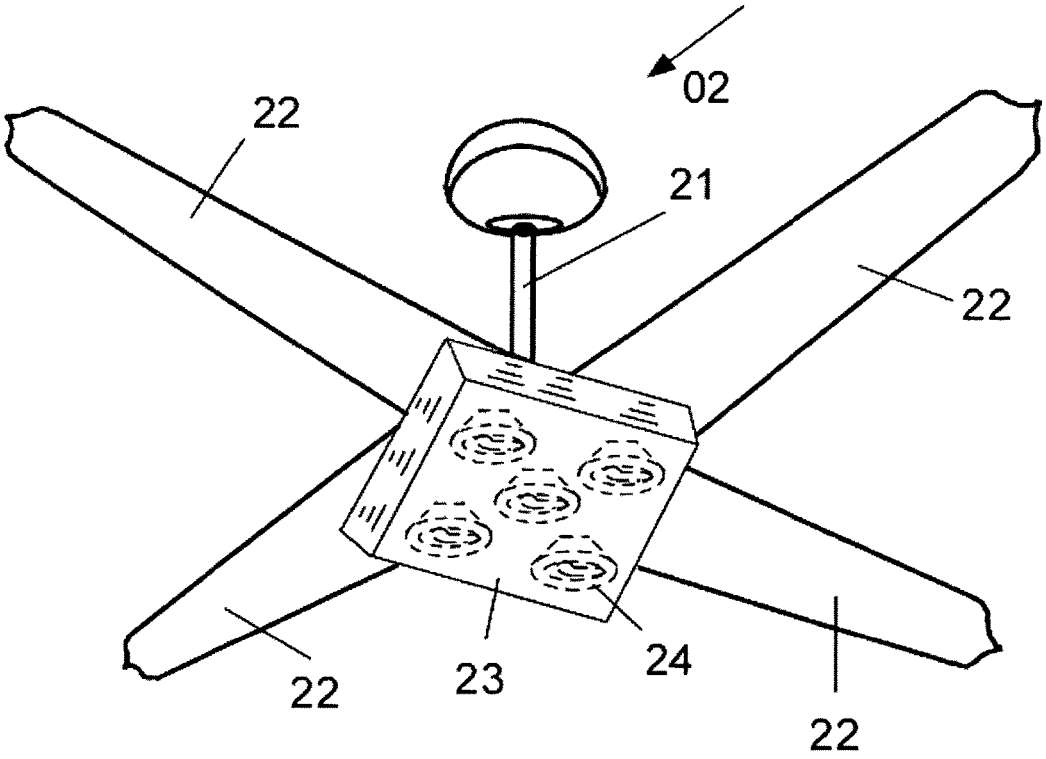
Fig. 2 (Prior Art)
FIG. 2 is an isometric view of a fluorescent lamp integrated to a ceiling fan according to another prior art.

FIG. 2 is an isometric view of fluorescent lamp, according to another prior art, integrated to a ceiling fan 02 that comprises a main tubular supporting rod 21, wings 22, fluorescent lamp box 23 that contains individual fluorescent lamps 24. The fluorescent lamps are bulky and the color of the light emitted from the fluorescent lamp cannot be changed on demand at specific time of the day.

Figure 3:
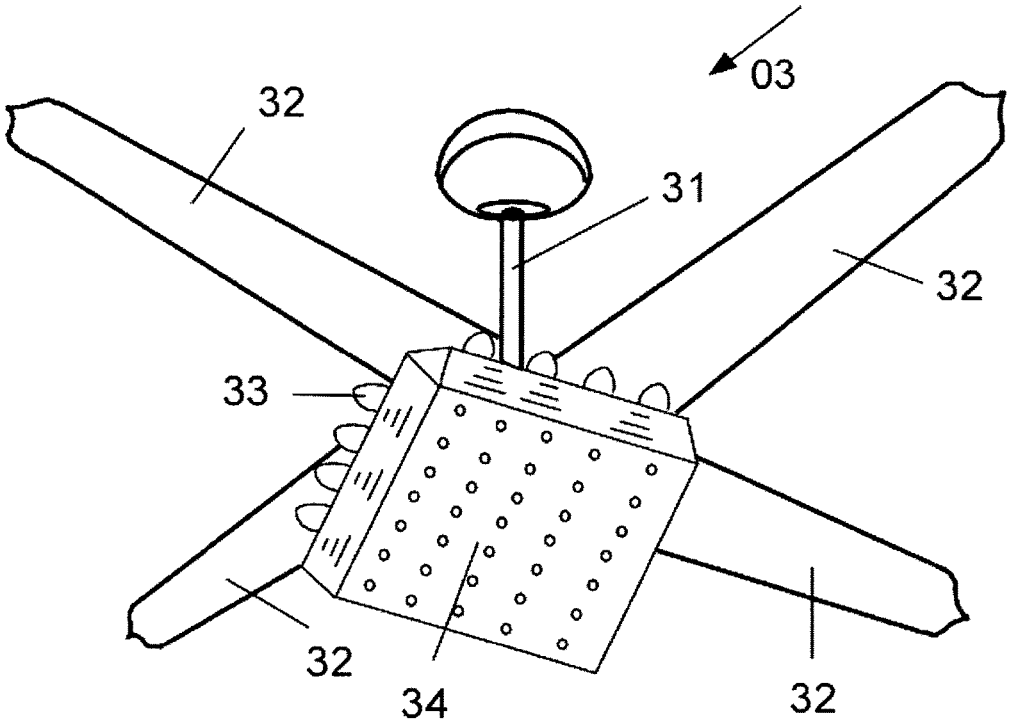
Fig. 3 (Prior Art)
FIG. 3 is an isometric view of an LED lamp integrated to a ceiling fan according to yet another prior art.
Figure 4:
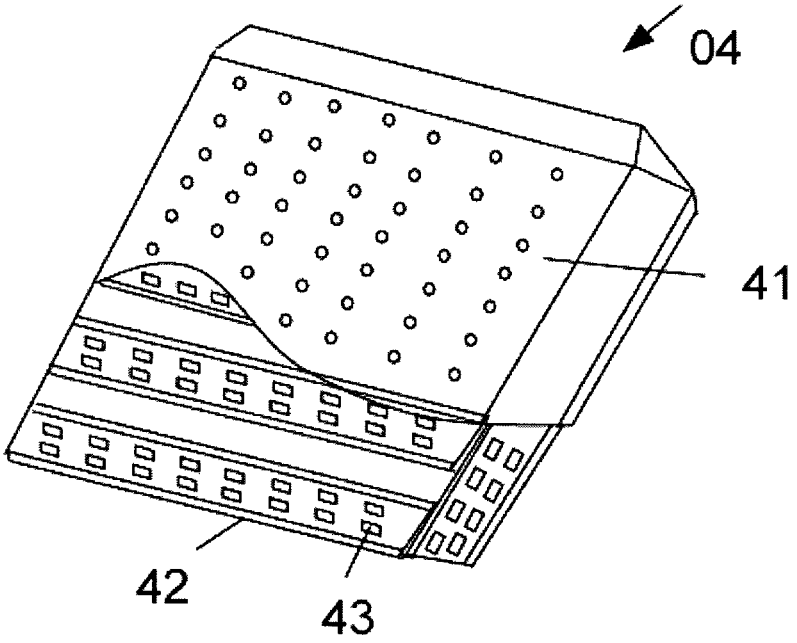
Fig. 4 (Prior Art)
FIG. 4 is an exploded view of LED light box shown integrated to a ceiling fan as shown in FIG. 3

FIG. 3 is an isometric view of LED lamp, according to another prior art, integrated to a ceiling fan 03 that comprises a main tubular supporting rod 31, wings 32, heat sinks 33 and LED lamp box 34 that contains multiplicity of LEDs that are shown in FIG. 4.

FIG. 4 is an exploded view of LED lamp box 04, shown in FIG. 3, that has a plastic body 41 that contains several LED strips 42 that comprises multiplicity of LEDs 43.

Figure 5:
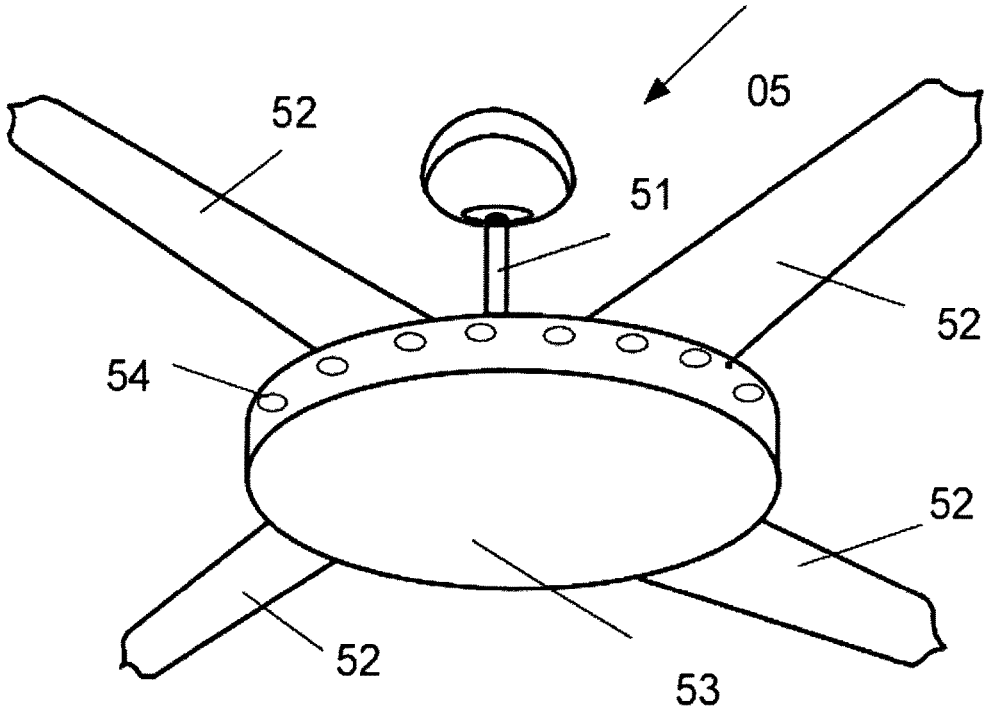
FIG. 5 is a flat circular LED lamp integrated to a ceiling fan according to one embodiment of the present invention.

FIG. 5 is an isometric view of LED lamp integrated to a ceiling fan 05, according to one of the embodiments of the present invention, that comprises a main supporting tubular rod 51, wings 52, flat circular LED flat lamp box 53 that has vent holes 54 for cooling LEDs and packaged LEDs shown later in FIGS. 6B and 7. Means for electrical connection, not shown in the FIG. 5, to the lamp and fan go through the main supporting tubular rod 51.

Figure 6A:
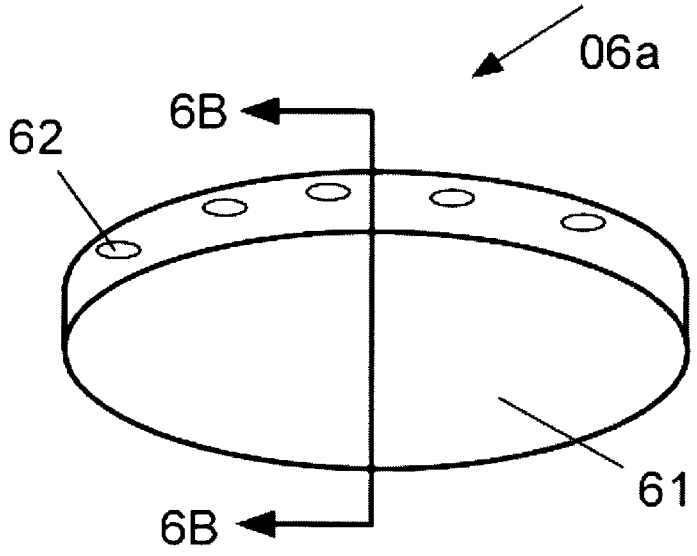
FIG. 6A is the flat circular lamp depicting the line of cross-section for revealing the individual LEDs.

FIG. 6A shows the line of cross-section 6B-6B in the flat circular light box 06*a* for revealing multiplicity of LED packages inside the flat circular disk 61. The vent holes 62 are provided for cooling LEDs. The flat circular disk 61 that contains multiplicity of LED packages can be made of any translucent plastic material such as, polycarbonate or polyethylene or plexiglass or polyester or parylene or polyimide and having patterns such as prismatic pattern or lenticular lens pattern or corrugated pattern.

Figure 6B:
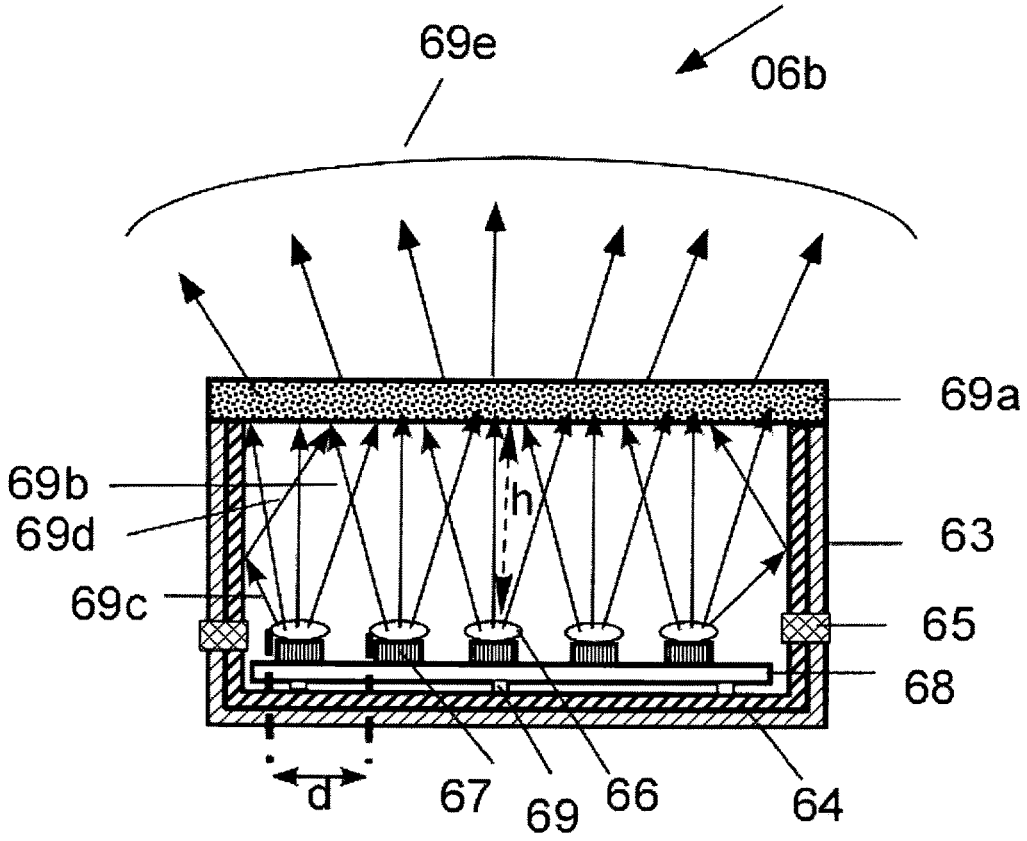
FIG. 6B shows the cross-sectional view of the flat circular lamp.

FIG. 6B is the cross-sectional view of the flat circular light box 06*b* and the box 63 can be made of translucent plastic materials like plexi-glass or poly-carbonate or polyester or parelene or polyethylene or polyimide. The inside surface of the light box is covered with a reflective layer 64 that can be made out of Aluminum or Chromium. The light box has vent holes 65 at the side for cooling the LED packages 66. LED package 66 has heat sink 67 for additional cooling and these are mounted on a metal core printed circuit board (PCB) 68 that has supports 69 for assembling to the bottom of the light box. For the sake of simplicity, package details of LED and the layers in between LED package and LED chip with all the layers between the chip and PCB are not shown in FIG. 6B. In the illustration shown in FIG. 6B, LED packages are assembled on PCB with a pitch of 'd' and the packages are at a depth of 'h' from the surface of a diffuser 69*a*. The diffuser 69*a* can be made of plastic or glass. The parameters 'd' and 'h' are optimized to obtain an uniform and high brightness of light rays 69*e* coming out of the diffuser. In the illustration, the light rays 69*b* emitted by individual LED packages overlap at the inner surface of diffuser 69*a*. The light ray 69*c*, for example from the LED package at the extreme left is incident on the reflector 64 and get reflected as light ray 69*d* that travels towards the diffuser 69*a*. The number of LED packages shown in FIG. 6B is only for illustration and this number is based on the brightness level needed for the main lamp. The LEDs employed in the packages can emit white light or red light or blue light or green light and the packages can be assembled in sequence of red light emitting, blue light emitting and green light emitting packages. In addition, LED packages with yellow light emission can also be used. The sequence of assembly of LED packages based on color of light can be changed depending on customer requirement.

Figure 7:
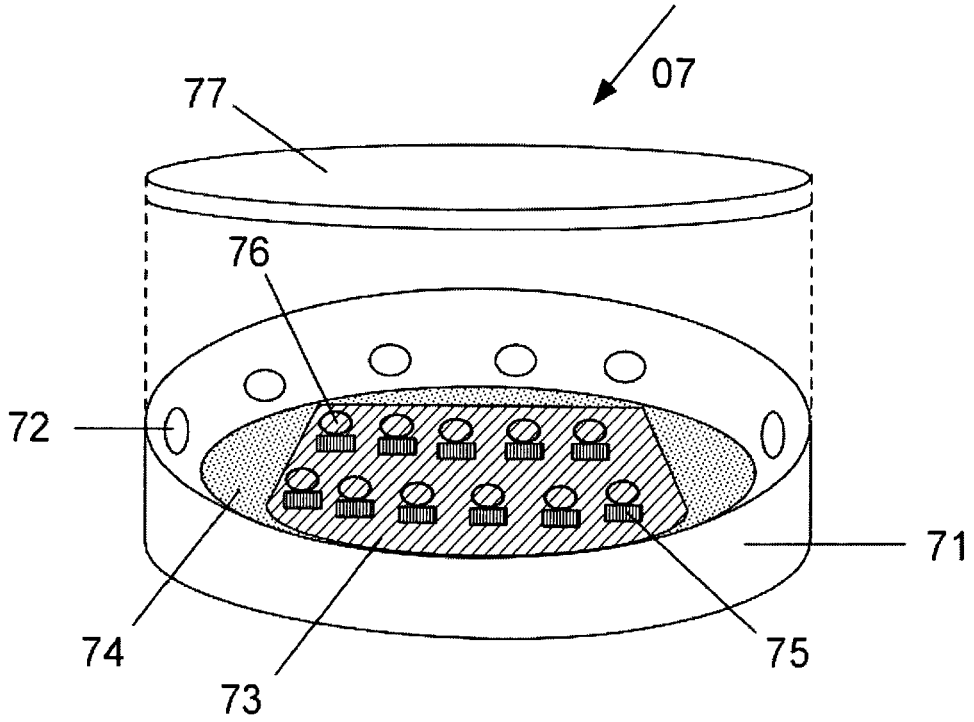
FIG. 7 is an isometric view of the flat circular lamp whose cross section is shown in FIG. 6B.

FIG. 7 is an isometric view of the flat circular LED lamp whose cross-section is shown in FIG. 6B. The flat circular LED lamp 07 comprises the main body 77 with its side surface 71. The main body can be made of plexi-glass or poly-carbonate or parylene or polyester or polyethylene or polyimide. It further comprises vent holes 72 for cooling LED packages 76 with heat sink 75, printed circuit board 73 and support structure 74 for supporting the PCB and containing power connectors to the PCB for supplying power to LED package. For simplicity, power connectors, diffuser and internal reflector for the main body are not shown in FIG. 7.

The LEDs employed in the flat circular lamp, integrated to the ceiling fan shown in FIG. 5 Individually emit either white light or red light or green light or blue light or yellow light.

Figure 8:
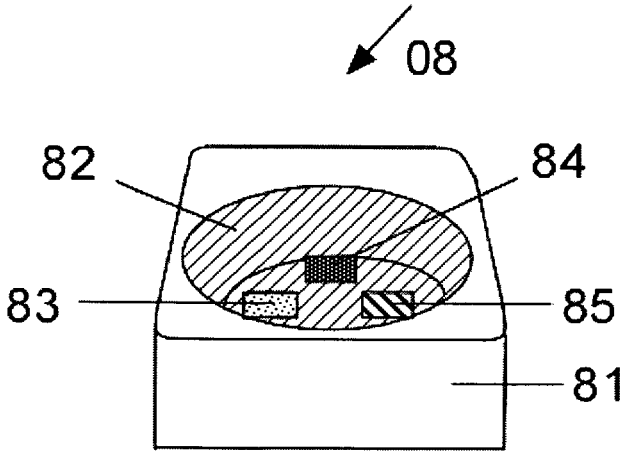
FIG. 8 is the isometric view of packaged Red, Blue and Green (RGB) LEDs for use in LED lamp in one of the embodiments of the present invention.

FIG. 8 is an isometric view of a special LED package available from the company Osram Optosemiconductors that employs three LED chips in one package. Each chip emits a different color of light. The 3-in-one page of LED 08 comprises package body 81 incorporating red light emitting LED chip 83, green light emitting LED chip 84 and blue light emitting LED chip 85. The LED chips are contained in a cup-like structure that has internal reflecting surfaces 82. For the sake of simplicity, the connecting leads that supply driving voltage to LEDs for light emission are not shown in FIG. 8. When driving voltage is applied to the LED chips they emit the respective colors of light.

Figure 9:
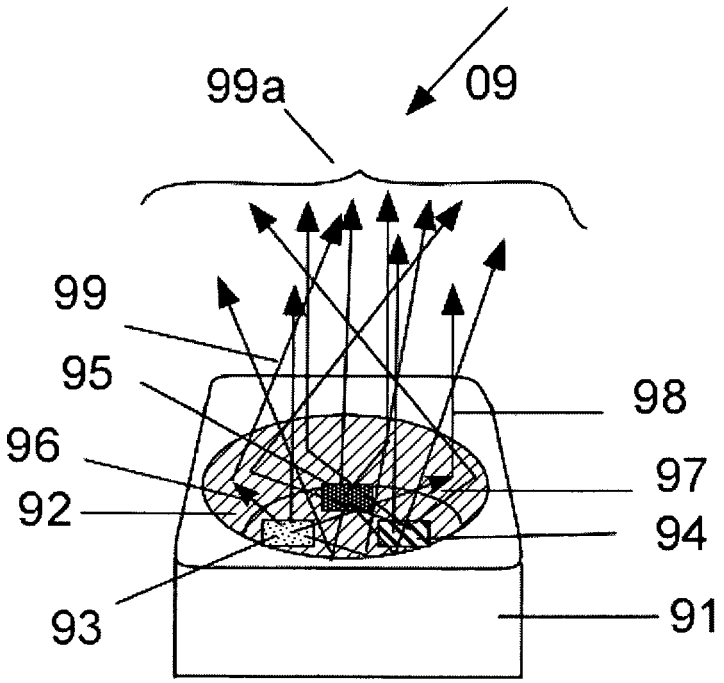
FIG. 9 is the isometric view, depicting the path of light rays emanating from RGB LEDs and finally coming out of the package shown in FIG. 8.

FIG. 9 shows path of light rays emanating from the chips shown in FIG. 8. Three-in-one chip package 09, illustrating the path of light rays, comprises a package body 91 containing red light emitting chip 93, green light emitting chip 95, blue light emitting chip 94 and a cup-like structure with internal reflective surfaces 92. LED chip emits light in all directions. In addition to the rays emitted by LED chips perpendicular to their own plane, they also emit light rays laterally. For example, red light emitting LED chip 93 emits light ray 96 and this ray is incident on the reflective surface 92 and get reflected as ray 99. A similar phenomenon takes place for green light and blue light. The green light emitting chip 95 emits light ray 97 and this ray is incident on the reflective surface 92 and get reflected as ray 98. Thus light loss is minimized and all the rays of three colors mix and emerge as white light 99*a*. In the illustration shown in FIG. 9, if the power is applied to only red light emitting LED chip 93, only red light will emerge. Similarly only green light will emerge if the power is applied to only green light emitting LED chip 95 and only blue light will emerge if the power is applied to only blue light emitting LED chip 94. If the power is applied to all the three color light emitting chips in certain ratio so that the luminous flux of green to red to blue is in the ration of 100:53.10, then the combined emerging light from all the three chips will be perfect white. Hues of different colors of light can be obtained by varying the ratio of power applied to the three chips. Thus colors of light can be obtained on demand if these three-in-one packages are employed in a main lamp.

Figure 10:
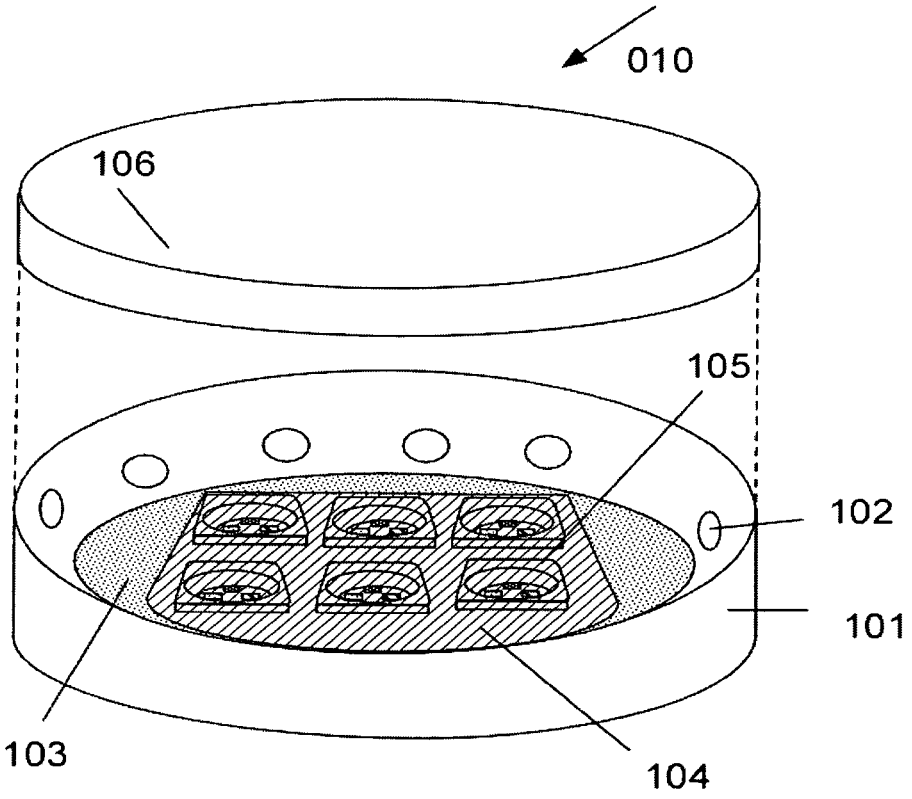
FIG. 10 is an isometric view of the flat circular LED lamp containing packaged LEDs.

FIG. 10 is an isometric view of another embodiment of the flat circular lamp of the present invention. The lamp 010 comprises the main body 101 made of plexi-glass or polycarbonate or parylene or polyester and the like, vent holes 102 for cooling LED packages, support structure 103, PCB 104 and three-in-one LED packages 105. The support structure 103 supports the PCB and contains LED power connectors for connecting them to PCB for powering LED packages. The power connectors, internal reflecting surfaces and the diffuser are not shown in FIG. 10 for simplicity. As described under FIG. 9, different ratios of power to the LED chips in each package can be applied to obtain desired colors of light and hues of desired colors of light. An LED drive controller, not shown in FIG. 10, can be programmed to apply varying power to LED chips in each package. The program can be set for different times of the day to apply different ratios of power to the green light emitting LED chip, red light emitting LED chip and blue light emitting LED chip. All red light emitting LED chips, all green light emitting LED chips and blue light emitting LED chips in each package can be connected in parallel for powering them in constant current pulse mode of operation. Thus depending on the time of the day, the customer can obtain different colors of light from the flat circular LED lamp including hues of white, like greenish-white, bluish-white and reddish-white. The LED drive controller can be located remotely to electrically connect the lamp through connecting wires or can be electrically coupled to the lamp through remote wireless unit.

Figure 11:
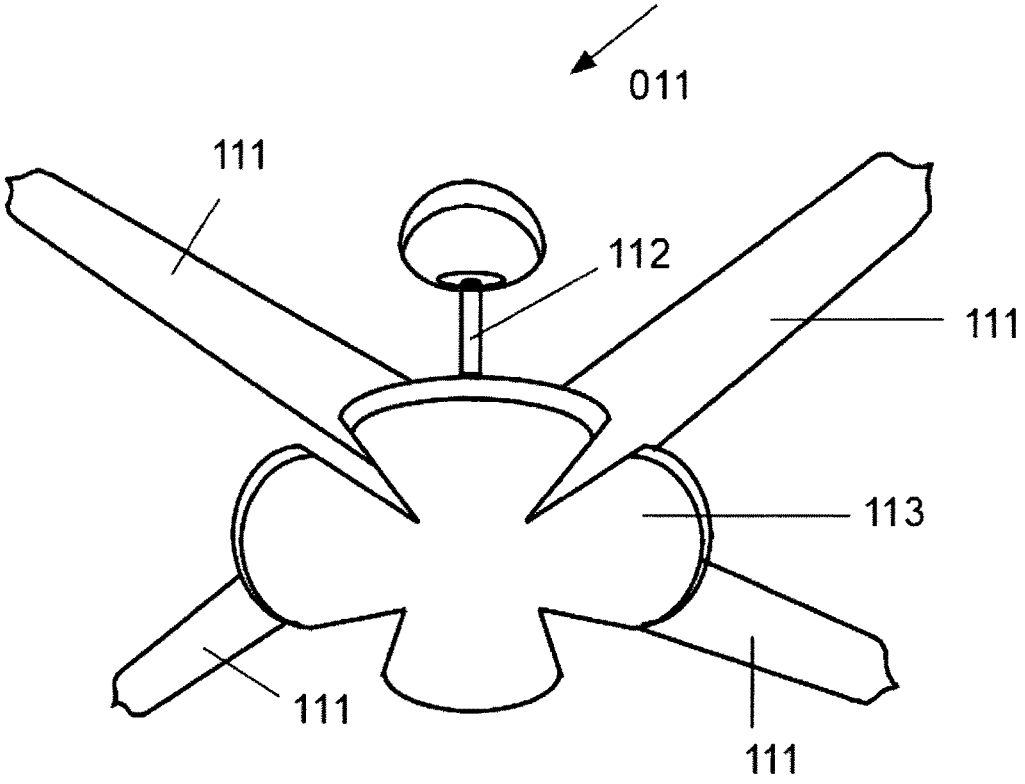
FIG. 11 shows another embodiment, according to the present invention, of LED lamp integrated to a ceiling fan.

FIG. 11 shows yet another embodiment of the present invention. An LED lamp integrated ceiling fan 011 comprises a main tubular support rod 112 through which electrically connecting wires for powering LEDs and fan pass, wings 111 and the LED lamp box 113 that contains multiplicity of packaged LEDs not shown in FIG. 11 for simplicity. The lamp box can contain either white light emitting LEDs or three-in-one packaged LEDs described in FIG. 9 depending on the color of light desired.

Figure 12:
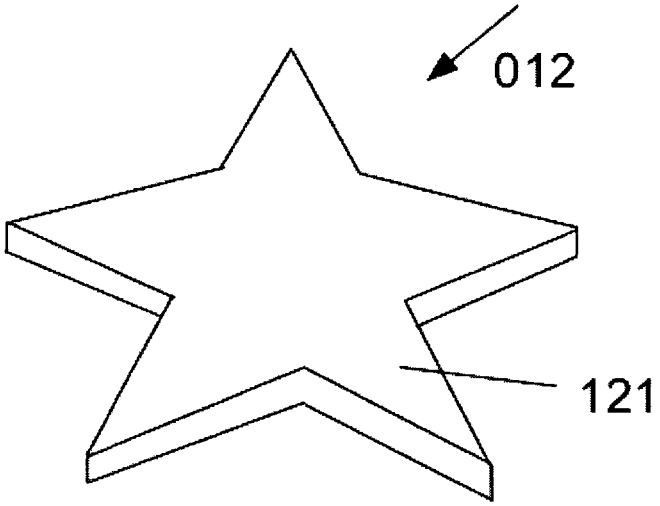
FIG. 12 shows one embodiment of star-like LED lamp box.

FIG. 12 shows a star-type of LED lamp 012 that comprises an LED lamp box 121 containing multiplicity of packaged LEDs not shown in FIG. 12 for simplicity. The lamp box 121 can contain either white light emitting LEDs or three-in-one packaged LEDs described in FIG. 9 depending on the color of light desired.

Figure 13:
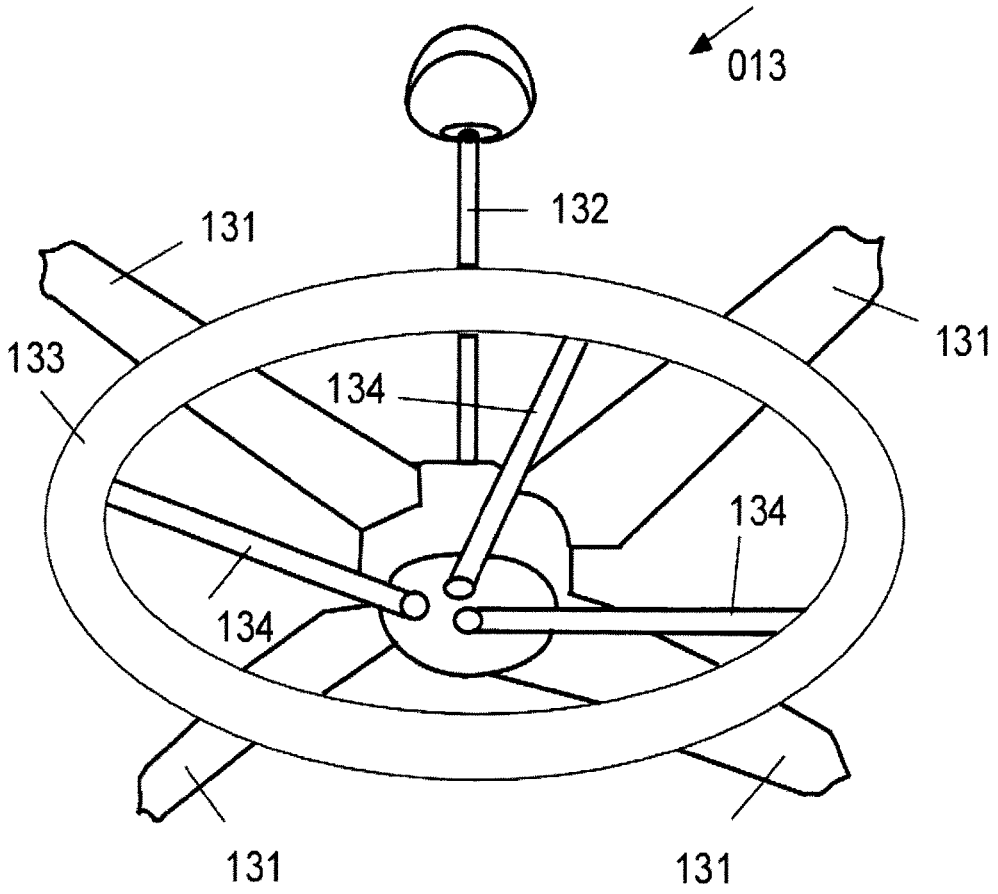
FIG. 13 shows yet another embodiment of the present invention with annular LED lamp integrated to a ceiling fan at the front of the fan.

FIG. 13 shows yet another embodiment of the present invention. An annular LED lamp integrated ceiling fan 013 comprises a main tubular support rod 132 through which electrically connecting wires for powering LEDs and fan pass, wings 131 and the annular LED lamp box 133 that contains multiplicity of packaged LEDs not shown in FIG. 13 for simplicity. The annular lamp box can contain either white light emitting LEDs or three-in-one packaged LEDs described in FIG. 9 depending on the color of light desired. Radial tubular rods 134 support the annular lamp and the electrical connecting wires, to power the lamp, goes through one of the rods.

Figure 14:
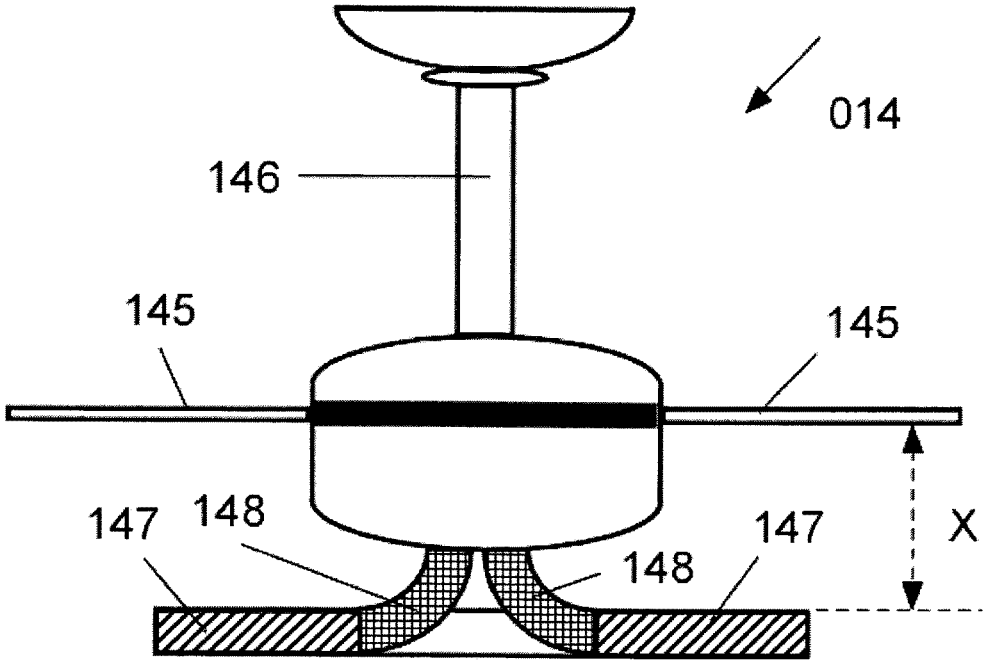
FIG. 14 shows the side-view of the lamp integrated to the ceiling fan, as shown in FIG. 13.

FIG. 14 is the side view of the annular LED lamp integrated fan shown in FIG. 13. The annular LED lamp integrated ceiling fan 014 comprises fan wings 145, a support tube 146 that contains power connectors to the fan and the LED lamp, annular LED lamp 147 and support tube 148 that contains power connectors to the annular LED lamp. Distance 'X' can be adjusted based on customers' requirements.

Figure 15:
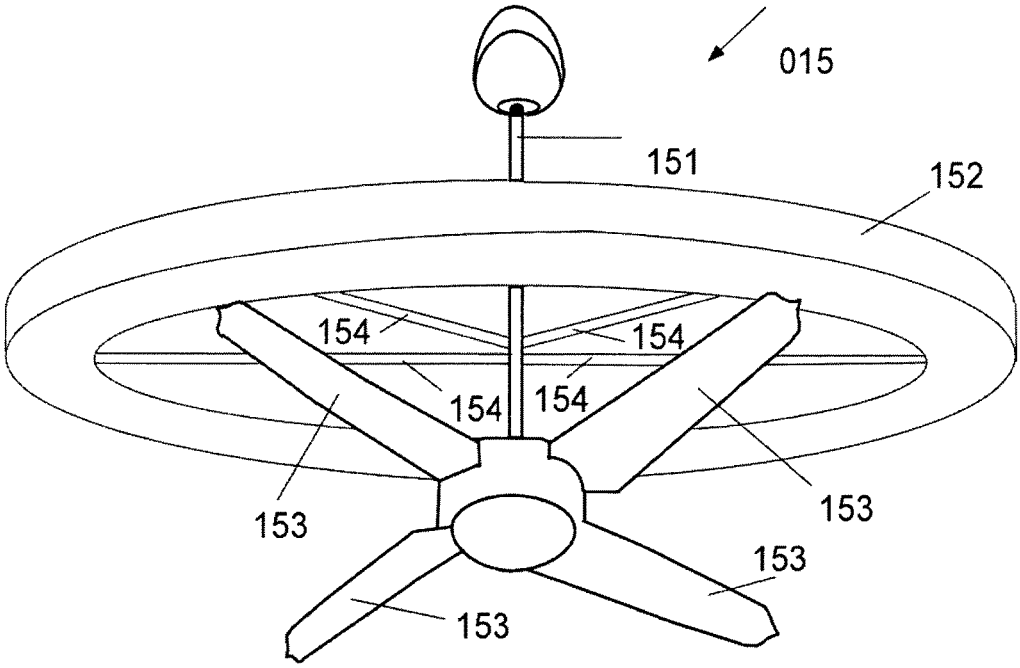
FIG. 15 shows another embodiment, according to the present invention, of annular LED lamp integrated to a ceiling fan at the back side of the fan.

FIG. 15 shows yet another embodiment of the present invention. The annular LED lamp integrated to a ceiling fan 015 comprises a support tube 151 that contains power connectors to LED lamp and fan, fan wings 153, annular LED lamp box 152 and radial support tubes 154 that contain power connectors to the annular LED lamp. The annular LED lamp box 152 contains multiplicity of packaged LEDs not shown in FIG. 15 for simplicity. The annular lamp box can contain either white light emitting LEDs or three-in-one packaged LEDs described in FIG. 9 depending on the color of light desired.

Figure 16:
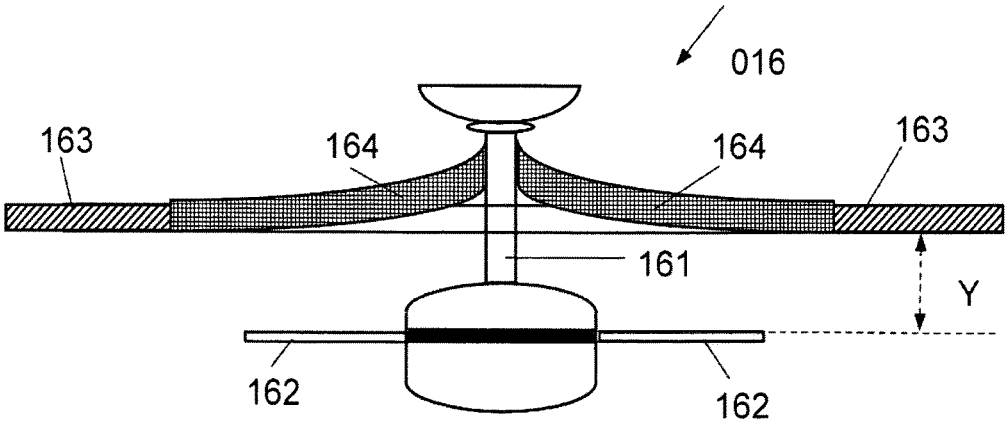
FIG. 16 shows the side-view of the lamp integrated to the ceiling fan, as shown in FIG. 15.

FIG. 16 is the side view of the annular LED lamp integrated fan shown in FIG. 15. The annular LED lamp integrated ceiling fan 016 comprises fan wings 162, a support tube 161 that contains power connectors to the fan and the LED lamp, annular LED lamp 163 and support tube 164 that contains power connectors to the annular LED lamp. Distance 'Y' can be adjusted based on customers' requirements.

Figure 17:
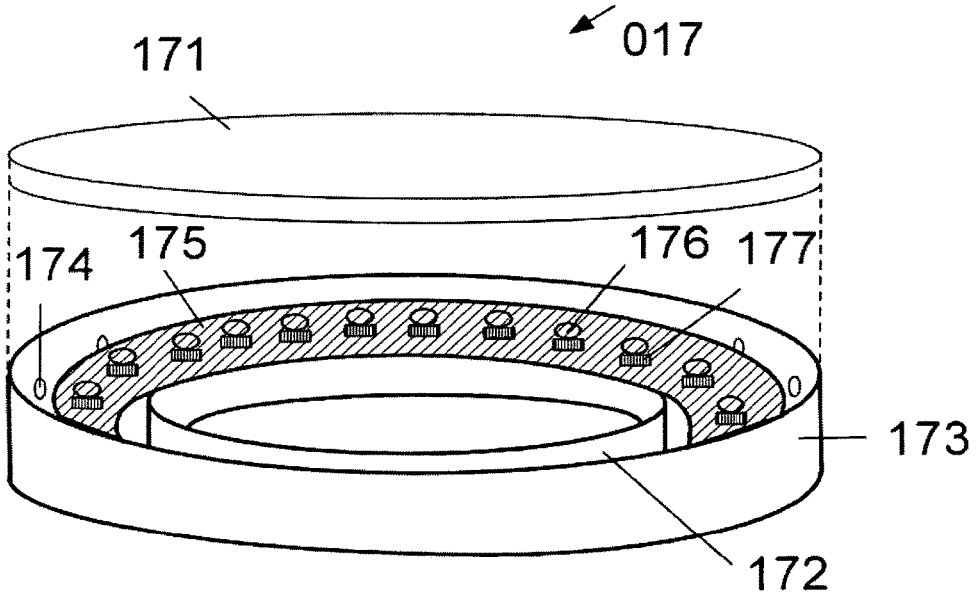
FIG. 17 shows an isometric view of the annular LED lamp containing multiplicity of packaged LEDs.

FIG. 17 is an isometric view of the annular LED lamp 017. The isometric view of the annular LED lamp 017 comprises a lamp box 171 that further comprises an outer lamp body 173, made of any translucent plastic material such as plexi-glass, polycarbonate, parylene, polyester, polyethylene, polyimide having patterns such as prismatic pattern or lenticular lens pattern or corrugated pattern, inner lamp body 172, made of the same material as the outer body 173, vent-holes 174 for cooling LED package, printed circuit board 175, LED package 176 and heat sink 177. The power connectors for powering LED lamp are not shown in FIG. 17 for simplicity. The LED packages in this illustration emit white light when powered. These packages can also be replaced by three-in-one packages described in FIG. 8 and FIG. 9. The different colors of light emitted from the three-in-one packages and programming of time and power through LED drive controller as described under FIG. 9 can be achieved with the annular LED lamp as well.

Figure 18:
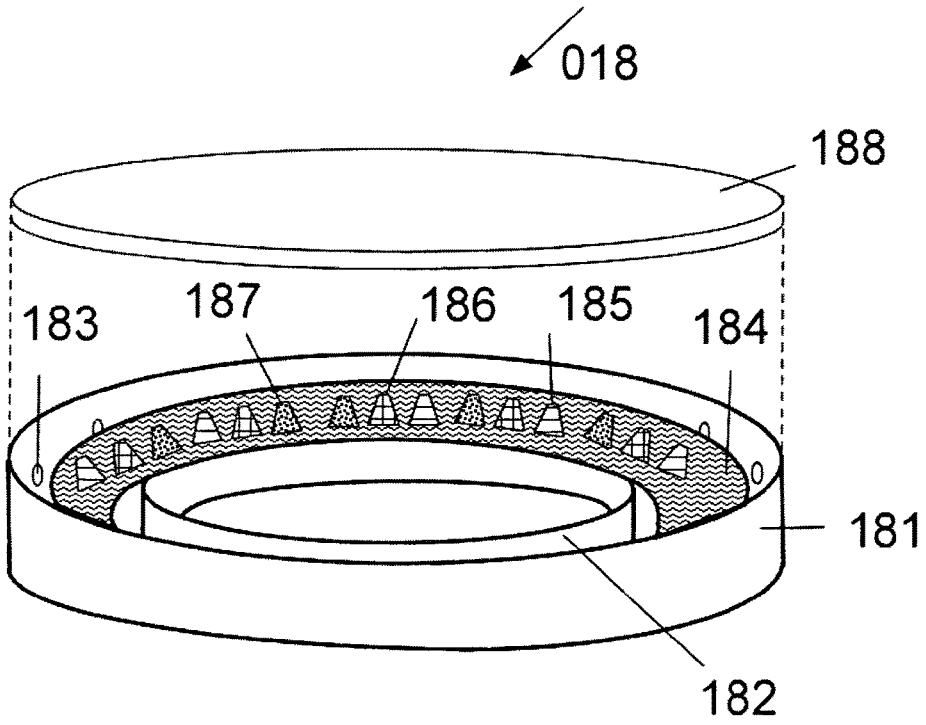
FIG. 18 shows an isometric view of another embodiment, according to the present invention, of annular LED lamp containing RGB LED packages.

FIG. 18 is another embodiment of an annular LED lamp 018 shown in isometric view. It comprises a lamp box 188 that further comprises an outer body 181, the mani body of the lamp being made of any translucent plastic material such as plexi-glass, parylene, polyester, polyethylene or polyimide, having patterns such as prismatic pattern or lenticular lens pattern or corrugated pattern, an inner body 182, made of the same material as the outer body 181, vent-holes 183, for cooling LED packages, flexible printed circuit tape 184, red light emitting LED package 185, blue light emitting LED package 186 and green light emitting ED package 187. For the sake of simplicity, the electrically conducting connecting lines to the LED packages and heat sinking element assembled to LED packages are not shown. The LED driver chip, not shown in FIG. 18, can also be provided on the flexible printed circuit tape 184. The LED packages 185, 186 and 187 can also be replaced by white light emitting LED packages. Similarly, the LED packages 185, 186 and 187 can also replaced by three-in-one LED packages as described in FIG. 8 and FIG. 9.

The LED driving controller external to the lamp can be programmed, on demand, to power selectively any LED package to obtain the desired color of light. The power to all LED pages, employing pulse with modulation, can be adjusted on the controller to obtain hues of colors of light from LED packages. The controller can also be programmed to adjust the color of light emitted from LED packages, depending on the time of the day or night.

It will be understood that one skilled in the art could modify the above basic design, geometries, sequence of assemblies, materials, processes and components. Various modifications and variations can be made in the construction, configuration, applications and/or operation of the present invention without departing from the scope or spirit of the invention. By way of examples, (i) the geometries and shapes of flat LED lamps can be modified to suit the customers' preferences (ii) the packaged LEDs described, especially three-in-one, can be modified to include 'two-in-one package' with color of light emission in a specified wavelength of the visible spectrum (iii) LEDs described above can be replaced with ultra-violet LEDs with remote phosphor plate to convert the UV in to visible light (iv) a remote phosphor plate can be employed to serve as the front and back surface if the outer body of the lamp and blue light emitting LED chips or UV emitting LED chips can be employed as the source of light to excite the phosphor to yield visible light (v) the ceiling fan can be replaced by any other type of fan including desk-type of fan or floor-type of fan (vi) the geometries and shapes of the LED lamps described above can be employed in structures other than ceiling fan (vii) material of the lamp body can be changed to be metallic at the side and translucent plastic at the front side and back side (viii) the translucent plastic material can be modified to include patters of any geometry to obtain light in a desired angle and direction (ix) the LED lamp can be directly integrated to a cavity or housing that is integral part of the main body of the lamp. Thus it is intended that the present invention covers the modifications and variations of the invention provided they come within the scope of the appended claims and their equivalents.

We claim:

1. A combination of a light box with an electric fan, comprising: said light box having a translucent plastic outer body comprising a base and at least one side wall extending from said base and defining a cavity with a rim, an optical diffuser placed on said rim to form an enclosure;

said translucent body having a plurality of internal surfaces, each of said respective internal surfaces being coated with an optically reflective coating;

said translucent body having a plurality of vent holes configured to cool said enclosure;

said light box containing a multiplicity of light emitting diode (LED) packages within said enclosure;

said LED packages assembled with a predetermined pitch inside said light box;

said LED packages further assembled with a predetermined distance from an internal surface of said optical diffuser;

said predetermined pitch and said predetermined distance bearing a fixed relationship for uniform light emission from said light box;

said LED packages further containing LED chips emitting different colors of light when powered;

said light box being continuously powered during operation of said fan to which said light box is integrated.

2. The combination of claim 1 wherein each said LED package has an internal conical structure with reflective surfaces.

3. The combination of claim 2 wherein said internal conical structure of each said LED package contains at least three LED chips.

4. The combination of claim 3 wherein said LED chips each emit one color of light.

5. The combination of claim 2 wherein said LED packages are mounted on a metal core printed circuit board.

* * * * *